US008474600B2

(12) United States Patent
Gambetti

(10) Patent No.: US 8,474,600 B2
(45) Date of Patent: Jul. 2, 2013

(54) ROTATING SYSTEM FOR UNSTACKING, TRANSPORTING, AND FEEDING SHEETS

(75) Inventor: Cristina Gambetti, Bologna (IT)

(73) Assignee: Baumer S.R.L., Castelfranco Emila (Modena) (IT)

( * ) Notice: Subject to any disclaimer, the term of this patent is extended or adjusted under 35 U.S.C. 154(b) by 130 days.

(21) Appl. No.: 13/235,415

(22) Filed: Sep. 18, 2011

(65) Prior Publication Data

US 2012/0067697 A1 Mar. 22, 2012

(30) Foreign Application Priority Data

Sep. 20, 2010 (IT) ..... BO2010A0563

(51) Int. Cl.
*B66C 1/02* (2006.01)

(52) U.S. Cl.
USPC ..... 198/471.1; 198/377.04; 198/474.1; 198/803.5; 198/803.4; 493/315; 271/91

(58) Field of Classification Search
USPC ..... 198/803.5, 803.4, 474.1, 475.1, 471.1, 198/459.2, 377.02–377.06, 377.08; 493/315, 493/317; 271/91, 99, 100, 102, 107
See application file for complete search history.

(56) References Cited

U.S. PATENT DOCUMENTS

| | | | | | |
|---|---|---|---|---|---|
| 4,643,633 | A * | 2/1987 | Lashyro | ..... | 414/732 |
| 5,254,071 | A * | 10/1993 | Laroche | ..... | 493/96 |
| 5,426,920 | A * | 6/1995 | Quadalti | ..... | 53/564 |
| 5,662,577 | A * | 9/1997 | Reuteler | ..... | 493/315 |
| 5,997,458 | A * | 12/1999 | Guttinger et al. | ..... | 493/315 |
| 7,965,421 | B2 * | 6/2011 | Fan et al. | ..... | 358/3.26 |
| 2008/0227612 | A1 * | 9/2008 | Harston | ..... | 493/315 |

* cited by examiner

*Primary Examiner* — Mark A Deuble
(74) *Attorney, Agent, or Firm* — Andrew Wilford

(57) ABSTRACT

A rotating system to withdraw, to transport and to feed blanks having two rotating elements, a first sun shaft, a first planetary shaft and a second planetary shaft disposed coaxial among them, two first arms, a third planet shaft, one or more second arms, one or more gripper means, first transmission means able to rotate the first and the second planetary shafts, second transmission means able to rotate-oscillate the third planet shaft in an independent manner, first actuator means, second actuator means, synchronizer means.

17 Claims, 11 Drawing Sheets

ROTATING SYSTEM FOR UNSTACKING, TRANSPORTING, AND FEEDING SHEETS

FIELD OF THE INVENTION

The present invention concerns a rotating system to withdraw, to transport and to supply blanks.

More in particular, the present invention concerns a rotating system to withdraw blanks in proximity of the downstream end of a collection store, to transport the blanks toward a grasping conveyor, and to feed the same blanks above e/o against the conveyor while its relative transport belt moves in an determined direction with a determined linear transport speed.

BACKGROUND OF THE INVENTION

Currently the known rotating systems to withdraw, to transport and to feed blanks, see for example patent FR-2.487.310, have a series of drawbacks.

A first drawback is due to the fact that the known systems are not able to execute a rapid change of size with regards to the forms and/or to the dimensions of the blanks, and regarding the execution of the operations of withdrawal, of transport, and of feeding of the blanks.

A second drawback is due to the fact that through the known systems, when the grasping means (for example the suction cups) contact the blank for the grasping, the grasping means execute tangential movements, with consequent disagreeable relative movement (sliding) between the grasping means and the blank.

A third drawback is due to the fact that through the known systems, when the grasping means (suction cups) extract the blank from the collective store, the grasping means perform tangential movements, with consequential difficulties or defective extraction of the blank from the store.

A fourth drawback is due to the fact that through the known systems, when the grasping means (for example the suction cups) transport the blank from the collecting zone toward the zone of release, the tail of the same blank interferes with the downstream end of the store or with other organs of the system, with consequent damage and/or folding and/or bending of the blank and/or separation/detachment of the grasping means and/or other malfunctions.

A fifth drawback is due to the fact that through the known systems, when the grasping means (for example the suction cups) feed the blank above or against or along the moving grasping conveyor, as for example above or against or along a rectilinear moving suction belt, the grasping means move the blank along a circular path with a tangential speed with is different with respect to the linear speed of the suction belt, with consequent disagreeable relative movements (sliding) between the blank and the suction belt.

A sixth drawback is due to the fact that through the known systems, when the grasping means (for example suction cups) feed the blank above or against the moving conveyor, as for example above or against or along a moving suction belt, the grasping means don't allow to obtain a parallel positioning of the blank with respect to the rectilinear plane of the conveyor, i.e. with respect to the rectilinear plane configured by the suction belt.

OBJECT OF THE INVENTION

The scope of the present invention is therefore to resolve the above mentioned drawbacks.

The invention, which is characterized by the claims, resolves the problem to create a rotating system to withdraw, to transport and to supply blanks, in which the system is characterized by the fact that it comprises:

two rotating elements which are disposed opposite one another and spaced among them;

a first sun shaft act to support and rotate the two rotating elements;

a first planetary shaft and a second planetary shaft disposed coaxial among them, in which the first and the second planetary shafts are disposed parallel and radially spaced with respect to the first sun shaft, in which the first and the second planetary shafts are supported in a rotating manner by the first and the second rotating elements, in which the first and the second planetary shafts are designed to move along a circular orbit around the first sun shaft;

two first arms, in which the two first arms extend with radial orientation with respect to the first and respectively to the second planetary shafts, in which the two first arms have two respective proximal portions respectively fixed on the first and second planetary shafts;

a third planet shaft, in which the third planet shaft is supported in a rotating manner by respective distal portions of the respective two first arms;

one or more second arms, in which the one or more second arms extend with radial orientation with respect to the third planet shaft, in which the one or more second arms have proximal portions fixed on the third planet shaft;

one or more gripper means, in which the one or more gripper means are supported in proximity of the distal portions of the one or more second radial arms;

first transmission means, in which the first transmission means are able to rotate the first and the second planetary shafts in the same direction with respect to their axis, in relationship of phase with respect to the rotation and to the angular positions of the two rotating elements;

second transmission means, in which the second transmission means are able to rotate-oscillate the third planet shaft in independent manner with respect to the rotation and with respect to the angular positions of the two rotating elements and in an independent manner with respect to the rotation and with respect to the angular positions of the two planetary shafts;

first actuator means able to rotate the first sun shaft;

second actuator means able to rotate-oscillate the third planet shaft by the second transmission means;

synchronizer means able to synchronize the first and the second actuator means.

BRIEF DESCRIPTION OF THE DRAWINGS

Further features and advantages of the present invention will become more readily apparent from the following detailed description of an embodiment of the invention, described here purely by way of example without limitation, and described with reference to the enclosed drawing in which.

FIGS. from 4A to 4H illustrate an exemplificative form of operation of the system object of the present invention.

DESCRIPTION OF THE PREFERRED EMBODIMENT

With reference to the FIGS. 1, 2 and 3, the system able to withdraw, to transport and to feed blanks, in the exemplificative illustrated embodiment, comprises two orbiting gripper units, G1 and G2, substantially and functionally identical among them, as better comprehensible hereinafter, in which the gripper units G1 and G2 are arranged in an opposed manner among them.

In such context, the rotating system can include one or two or three or more gripper units, G1, G2, etc., having the same modus operandi, without going out from the inventive concepts protected through the present invention.

With reference to the description, will be hereinafter described in a detailed manner the first orbiting gripper unit G1 only and, with reference to the second orbiting gripper unit G2, it will be described in a synthetic manner, using for similar elements the same numbers of the first gripper unit G1 with a different suffix.

Figure 1:
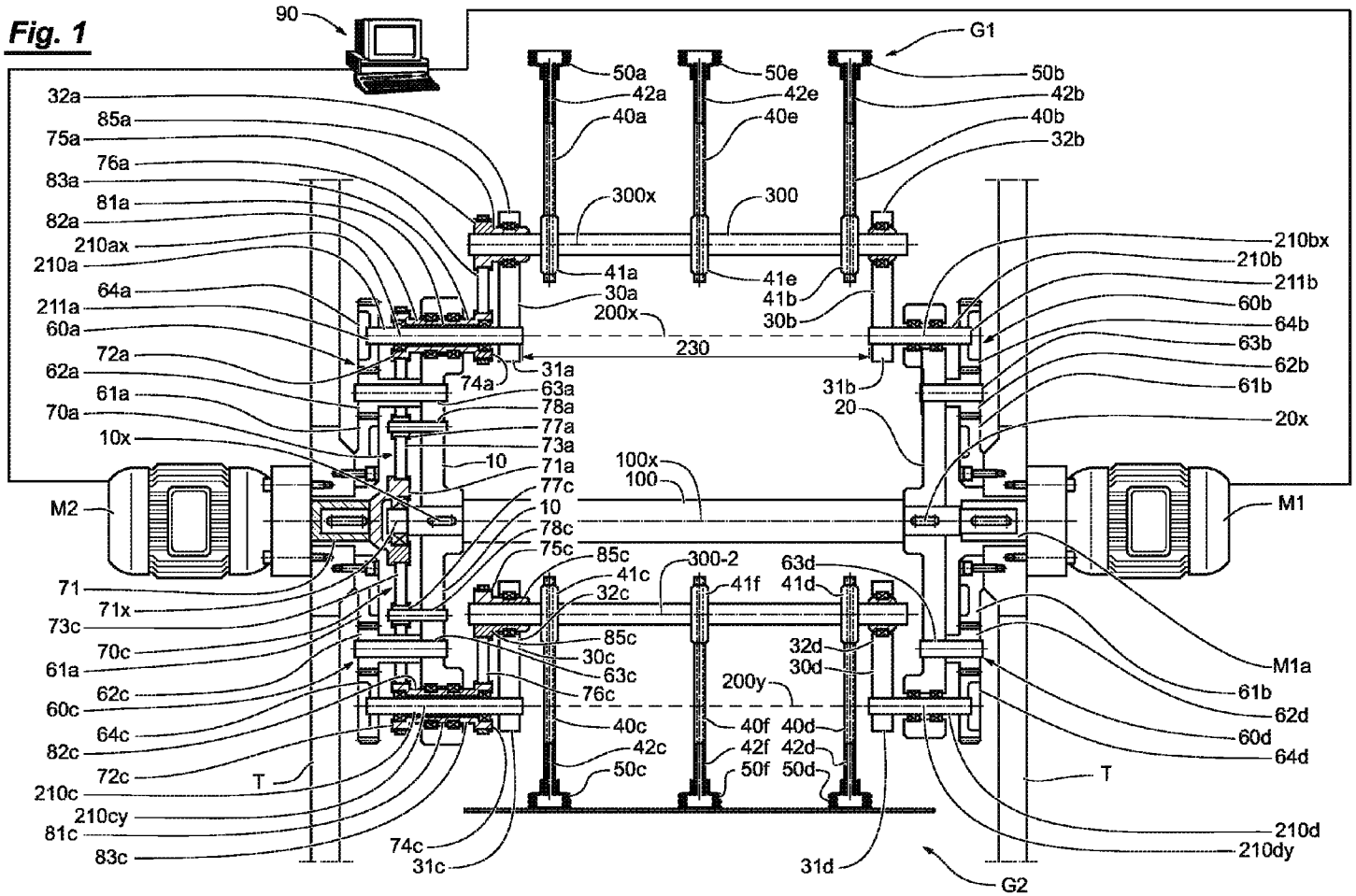
FIG. 1 is a schematically front view of the system object of the present invention with some sectioned parts.
Figure 2:
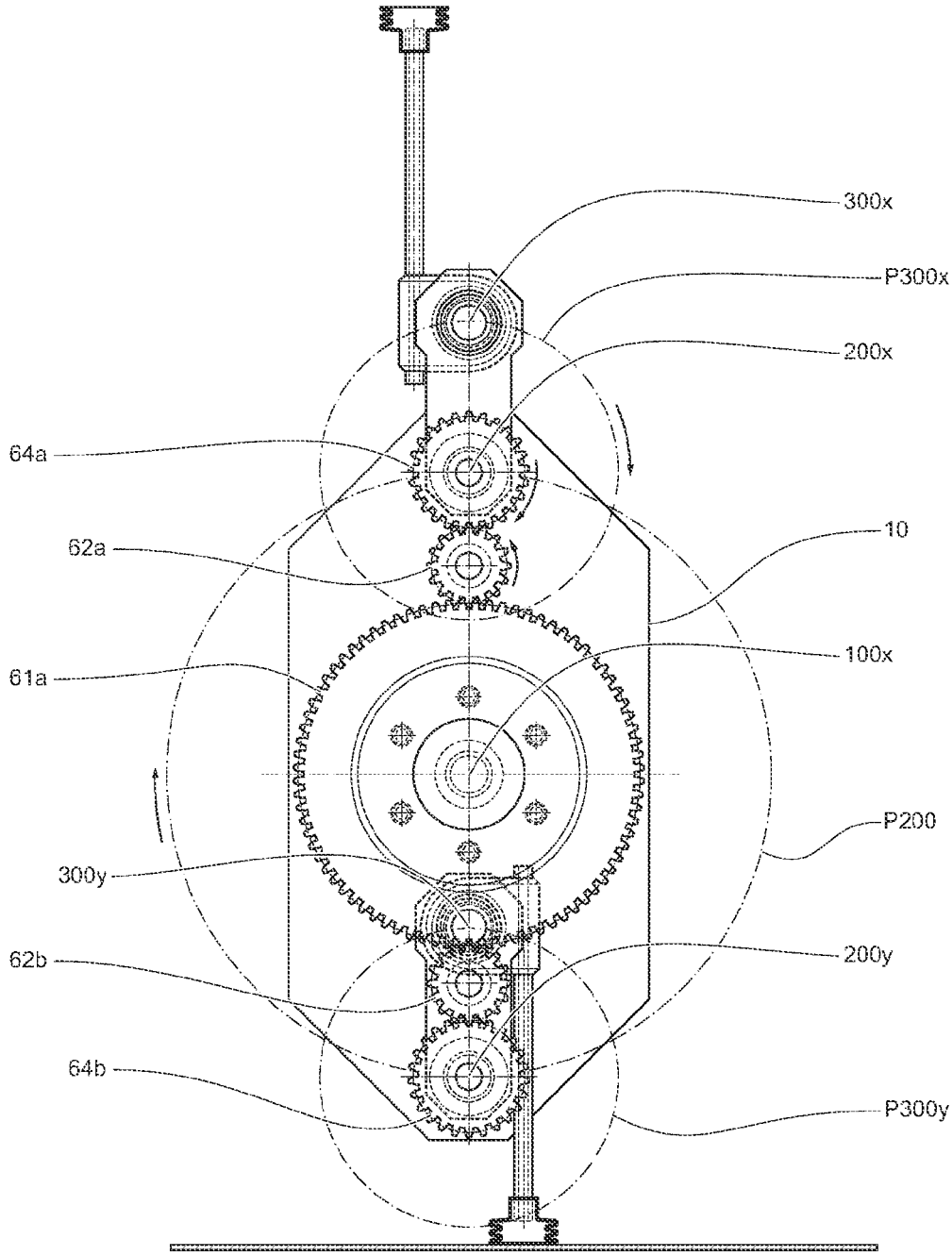
FIG. 2 is a view from left toward right side with reference to FIG. 1 and able to show schematically the first transmission means of the system object of the present invention.
Figure 3:
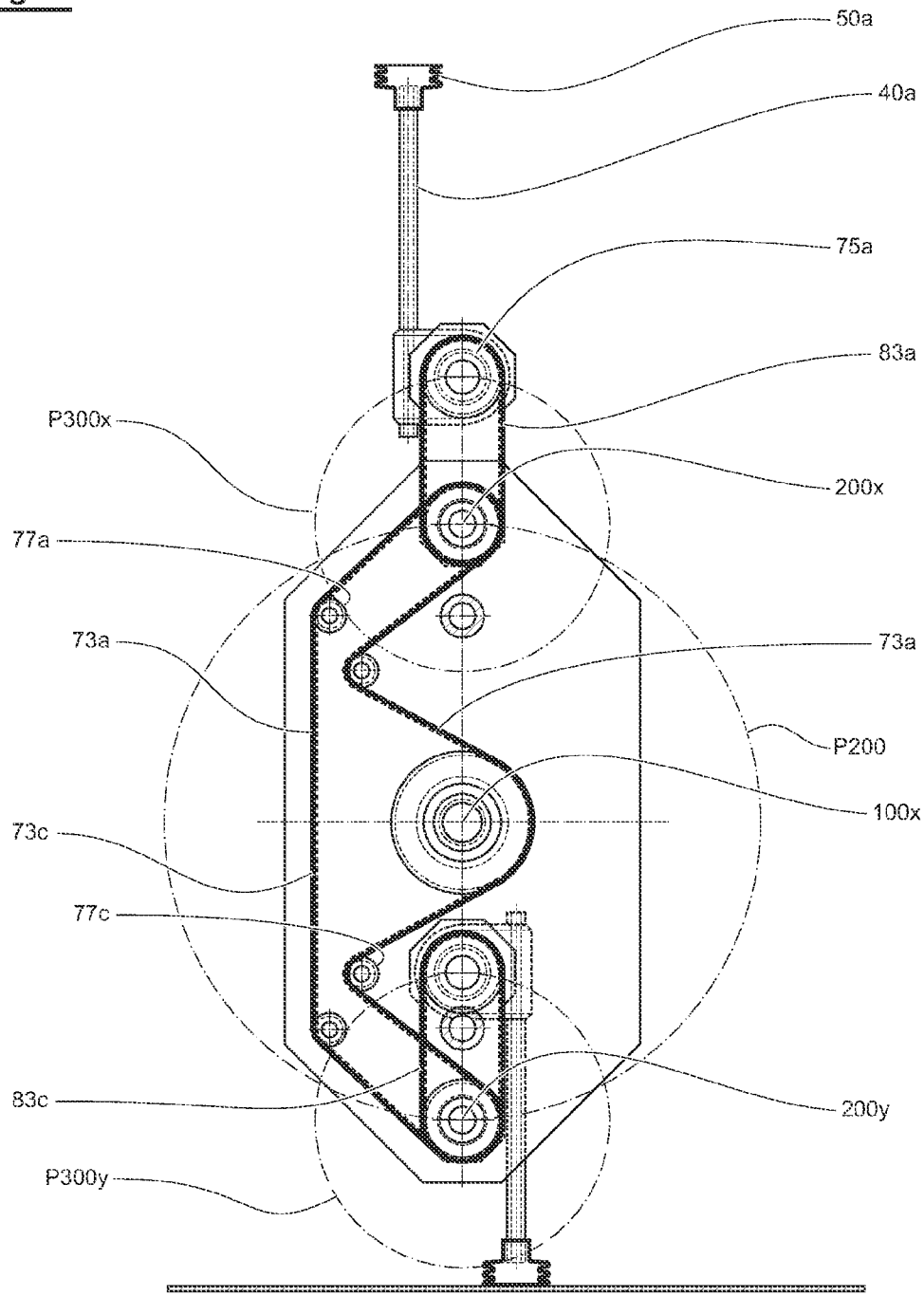
FIG. 3 is view from left toward right side with reference to FIG. 1 and able to show schematically the second transmission means of the system object of the present invention.

With reference to the first orbiting gripper unit G1 and to the FIGS. 1, 2 and 3, the system to withdraw, to transport and to feed blanks comprises:

two rotating elements 10 and 20;

a first sun shaft 100;

a first planetary shaft 210*a* and a second planetary shaft 210*b;* two first arms 30*a* and 30*b;* a third planet shaft 300;

one or more second arms 40*a*, 40*e*, 40*b;* one or more gripper means 50*a*, 50*e*, 50*b;* first transmission means 60*a*-60*b;* second transmission means 70*a;* first actuator means M1;

second actuator means M2;

synchronizer means 90;

The two rotating elements 10 and 20 are disposed opposite one another and are axially spaced among them with the purpose to support the two orbiting gripper units G1 and G2.

The first sun shaft 100 is able to support and to rotate the two rotating elements 10 and 20 and, as hereinafter described, the opposite ends of the sun shaft 100 are supported by the frame T.

The first planetary shaft 210*a* and the second planetary shaft 210*b* are disposed coaxial among them configuring a relative planetary axis 200*x*.

The same two planetary shafts 210*a* and 210*b* are disposed parallel and radially spaced with respect to the first sun shaft 100, and they are supported in their central zone in a rotating manner by the first 10 and the second 20 rotating elements, with the purpose to move the two planetary shafts 201*a* and 210*b* along a circular orbit P200 (see FIGS. 2 and 3) around the first sun shaft 100 by the rotation of the two rotating elements 10 and 20.

The two first arms 30*a* and 30*b* extend with radial orientation with respect to the first 210*a* and respectively to the second 210*b* planetary shafts, in which the two first arms 30*a*, 30*b* have two respective proximal portions, 31*a* and 31*b*, respectively fixed on the first 210*a* and on the second 210*b* planetary shafts.

The third planet shaft 300 is supported in rotating manner by respective distal portions 32*a* and 32*b* of the respective two first arms 30*a* and 30*b*.

The second arms 40*a*, 40*e*, 40*b* extend with radial orientation with respect to the third planet shaft 300, and they have proximal portions 41*a*, 41*e*, 41*b*, fixed on the third planet shaft 300 and, preferably, see FIG. 2, they are fixed to the third planet shaft 300 in a way offset with respect to the axis 300*x* of oscillation-rotation of the planet shaft 300, with a tangential positioning with respect to the axis 300*x* of rotation-oscillation.

The gripper means 50*a*, 50*e*, 50*b*, are supported in proximity of the distal portions 42*a*, 42*e*, 42*b* by the one or more second radial arms 40*a*, 40*e*, 40*b*.

The first transmission means 60*a*-60*b* are able to rotate the first 210*a* and the second 210*b* planetary shafts in the same direction with respect to their axis 210*ax* and 210*bx*, as well as in relationship of phase with respect to the rotation and to the angular positions of the two rotating elements 10 and 20.

The second transmission means 70*a* are able to rotate-oscillate the third planet shaft 300 in an independent manner with respect to the rotation and with respect to the angular positions of the two rotating elements 10 and 20, as well as in an independent manner with respect to the rotation and with respect to the angular positions of the two planetary shafts 210*a* and 210*b*.

The first actuator means M1 are able to drive the first sun shaft 100 and they can assume various configurations.

The second actuator means M2 are able to drive the second transmission means (70*a*).

The synchronizer means 90 able to synchronize the first M1 and the second M2 actuator means, or to control the second M2 actuator means as best comprehensible described hereinafter.

Likewise in comparison with all above described, the second opposed orbiting gripper unit G2 comprises: >—the two rotating elements 10 and 20, the first sun shaft 100;

two planetary shafts 201*c* and 210*d* supported to move along the circular orbital path P-200;

one or more first arms 30*c* and 30*d* having a proximal portion 31*c* and 31*d* respectively fixed on the planetary shafts 210*c* and 210*d;* a third planet shaft 300-2 supported in rotating manner by a distal portion 32*c* and 32*d* of the one or more first arms 30*c* and 30*d;* one or more second arms 40*c*-40*f*-40*d* having a proximal portion 41*c*-41*f*-41*d* fixed to the third planet shaft 300-2;

one or more gripper means 50*c*-50*f*-50*d* supported in proximity of the distal portions 42*c*-42*f*-42*d* of the one or more second radial arms 50*c*-50*f*-50*d;* first transmission means 60*c*-60*d* able to rotate the second planetary shafts 210*c* and 210*d;* second transmission means 70*c* able to oscillate-rotate the third planet shaft 300-2 in an independent manner with respect to the rotation of the two rotating elements 10 and 20 and in an independent with respect to the rotation of the two planetary shafts 210*c* and 210*d;* first actuator means M1;

second actuator means M2;

synchronizers means 90.

With reference to the two rotating elements, 10 and 20, preferably, see FIGS. 2 and 3, they comprise two plates supported by the first shaft 100, driven to rotate in the same direction with respect to a respective central axis, 10*x* and 20*x*, in which the axis 10*x* and 20*x* are coaxial with respect to the first axis 100*x* of the first sun shaft 100.

With reference to the first sun shaft 100 it is driven in rotation by the first actuator means M1 and it is supported in rotating manner by the frame T, as, for example, through a sleeve-pulley 71, better described hereinafter, and by a coaxial engagement with a shaft M1*a* that acts as a support, in which the shaft M1*a* is associated with the servomotor M1, in which the servomotor M1 is fixed to the frame T.

The first planetary shaft 210*a* is supported in a rotating manner by the first rotating element 10 and, more in particular, it is supported in a rotating manner preferably by an rotating engagement with a first sleeve 81*a*, in which the sleeve 81*a* is supported in a rotating manner by a rotating engagement by the rotating element 10.

The second planetary shaft 210*b* is supported in a rotating manner by a rotating engagement by the second rotating element 20.

The first planetary shaft 210*a* and the second planetary shaft 210*b* have their respective axis 210*ax* and 210*bx* axially aligned among them, configuring in this manner a second planetary axis 200*x*.

Furthermore, for reasons that will result subsequently, the first planetary shaft 210*a* and the second planetary shaft 210*b* are positioned axially spaced, with the purpose to form an aperture 230 among them, in which the aperture 230 has such a dimension able to allow the free passage of the one or more second arms 40*a*, 40*e*, 40*b* through the aperture 230.

The first transmission means 60*a*-60*b* are able to rotate the first planetary shaft 210*a* and the second planetary shaft 210*b* together, in the same direction of rotation, in relationship of phase with respect to the rotation of the two rotating elements 10 and 20, with a so-called epicycloidal rotation.

The first transmission means 60*a*-60*b* comprise two separate transmission units, 60*a* and 60*b*, in which the first transmission unit 60*a* is able to rotate the first planetary shaft 210*a*, and the second transmission unit 60*b* is able to rotate the second planetary shaft 210*b*.

The first transmission unit 60*a* is positioned along the external side of the first rotating element 10 and, for example, the first transmission unit 60*a* comprises:

a first sun gear wheel 61*a* supported by the frame T;

a second idle gear wheel 62*a*, in which the second wheel 62*a* is in mesh with the first sun gear wheel 61*a*, in which the idle gear wheel 62*a* is supported in a rotating manner by a pin 63*a*, in which the pin 63*a* is supported by the first rotating element 10;

a third gear wheel 64*a*, in which the third wheel 64*a* is in mesh with the second gear idle gear wheel 62*a*, in which the third gear wheel 64*a* is supported and fixed by an end portion 211*a* with the first planetary shaft 210*a*.

The second transmission unit 60*b* is positioned along the external side of the second rotating element 20 and, for example, the second transmission unit 60*b* comprises:

a first sun gear wheel 61*b* supported by the frame T;

a second idle gear wheel 62*b*, in which the second wheel 62*b* is in mesh with the first sun gear wheel 61*b*, in which the idle gear wheel 62*b* is supported in a rotating manner by a pin 63*b*, in which the pin 63*b* is supported by the second rotating element 20;

a third gear wheel 64*b*, in which the third wheel 64*b* is in mesh with the second idle gear wheel 62*b*, in which the third gear wheel 64*b* is supported and fixed by an end portion 211*b* with the second planetary shaft 210*b*.

Likewise, with reference to the opposed orbiting gripper unit G2, there are first transmission means 60*c* and 60*d* which are able to rotate the opposite first 210*c* and second 210*d* planetary shafts by two separate transmission means 60*c* and 60*d*.

The first transmission means 60*c*, in a similar manner with respect to the analogous transmission means 60*a*, comprise: the gear wheel 61*a*, a second gear wheel 62*c*, a pin 63*c*, a third gear wheel 64*c* supported and fixed to the planetary shaft 210*c*.

The second transmission means 60*d*, in a similar manner with respect to the analogous transmission means 60*b*, comprise: the gear wheel 61*b*, a second gear wheel 62*d*, a pin 63*d*, a third gear wheel 64*d* supported and fixed to the planetary shaft 210*d*.

With reference to the second transmission means 70*a* regarding the first orbiting gripper unit G1 they preferably is comprise:

a first pulley 71*a*, in which the axis of rotation 71*x* coaxial with respect to the first axis 100*x;* a second pulley 72*a*, in which the second pulley 72*a* is fixed on an end portion 82*a* of a sleeve 81*a*, in which the end portion 82*a* is positioned to the external side with respect to the rotating element 10, in which the sleeve 81*a* is supported in a rotating manner by the first rotating element 10;

a first transmission belt 73*a* wound on the first pulley 71*a* and on the second pulley 72*a;* a third pulley 74*a*, in which the third pulley 74*a* is fixed on an end portion 83*a* of the sleeve 81*a*, in which the end portion 83*a* is positioned to the internal side with respect to the rotating element 10;

a fourth pulley 75*a*, in which the fourth pulley 75*a* is fixed on a second sleeve 85*a*, in which the second sleeve 85*a* is supported in rotating manner by a rotating engagement in proximity of the distal portion 32*a* of the first radial arm 30*a;* a second transmission belt 76*a* wound on the third pulley 74*a* and on the fourth pulley 75*a*; in which the first pulley 71*a* is operated in oscillation-rotation through the second actuator means M2, in which the second actuator means M2 is positioned to the exterior with respect to the rotating system and supported by the frame T.

Likewise, with reference to the opposed orbiting gripper unit G2, the opposed second transmission means 70*c* is comprise:

the first pulley 71*a* above mentioned, a second pulley 72*c*, in which the second pulley 72*c* is fixed on an end portion 82*c* of a sleeve 81*c*, in which the end portion 82*c* is positioned to the external side with respect to the rotating element 10, in which the sleeve 81*c* is supported in a rotating manner by the first rotating element 10;

a first transmission belt 73*c* (in the embodiment illustrated the belt 73*c* is the belt 73*a*) wound on the first pulley 71*a* and on the second pulley 72*c;* a third pulley 74*c*, in which the third pulley 74*c* is fixed on an end portion 83*c* of the sleeve 81*c*, in which the end portion 83*c* is positioned to the internal side with respect to the rotating element 10;

a fourth pulley 75*c*, in which the fourth pulley 75*c* is fixed on a second sleeve 85*c*, in which the second sleeve 85*c* is supported in rotating manner by a rotating engagement in proximity of the distal portion 32*c* of the first radial arm 30*c;* a second transmission belt 76*c* wound on the third pulley 74*c* and on the fourth pulley 75*c*.

With reference to the exemplificative embodiment of FIG. 1, the first pulley 71*a* is associated with a sleeve-pulley 71, in which the sleeve-pulley has a form as a cup element 71, in which the cup element 71 is supported in a rotating manner by the frame T, in which the sleeve-pulley 71 supports to its inside in a rotating manner the left free end of the first shaft 100.

With reference to the illustrated embodiment, the second transmission means 70*a* and 70*c* further comprise a respective idle rolls 77*a* and 77*c* supported by a respective pin 78*a* and 78*c*, in which the pins 78*a* and 78*c* are fixed to the first rotating element 10, as well as other similar other rolls illustrated in this embodiment, in which the rollers are able to configure the path of the belts.

With reference to the first rotating group G1, the first sleeve 81*a* supports internally in a rotating manner the second planetary shaft 210*a* by a rotating engagement, and the second sleeve 85*a* supports internally in a rotating manner the third planet shaft 300 while, on the opposed side, the second planetary shaft 210*b* è supported in a rotating manner by the second rotating element 20 by a rotating engagement and the third shaft 300 is supported in a rotating manner by the free end 32*b* of the arm 30*b* by a rotating engagement.

With reference to the first actuator means M1 and to the second actuator means M2, they comprise two separate servomotors, as for example two brushless servomotors, positioned in a fixed manner at the exterior of the two rotating element 10 and 20 and fixed to the frame T.

With reference to the synchronizers means 90, they preferably comprise a programmable control unit (CPU or similar) able to control the rotation of the two servomotors M1 and M2.

In a variant of the illustrated embodiment, the first actuator means M1 may be obtained by a mechanical connection with an operating machine, as for example by a mechanical connection with a packaging machine, with the purpose to obtain the rotation of the two rotating elements 10-20 in relationship of phase with the operative cycle of the packaging machine and, the second actuator means, M2, can comprise a brushless servomotor M2.

In this case, the control unit 90 executes the control of the second servomotor M2 on the base of the angular positions of the rotating elements 10 and 20 and, for such embodiment, preferably, the system further comprises a sensor of angular position, so called encoder, in which the sensor is able to detect the angular positions of the first shaft 100 and, therefore, the angular positions of the two rotating elements 10 and 20, in which the encoder is connected with the synchronizing means or with the programmable control unit 90 with the purpose to transmit to this control unit 90 the relative signals regarding the angular positions.

Figure 4A:
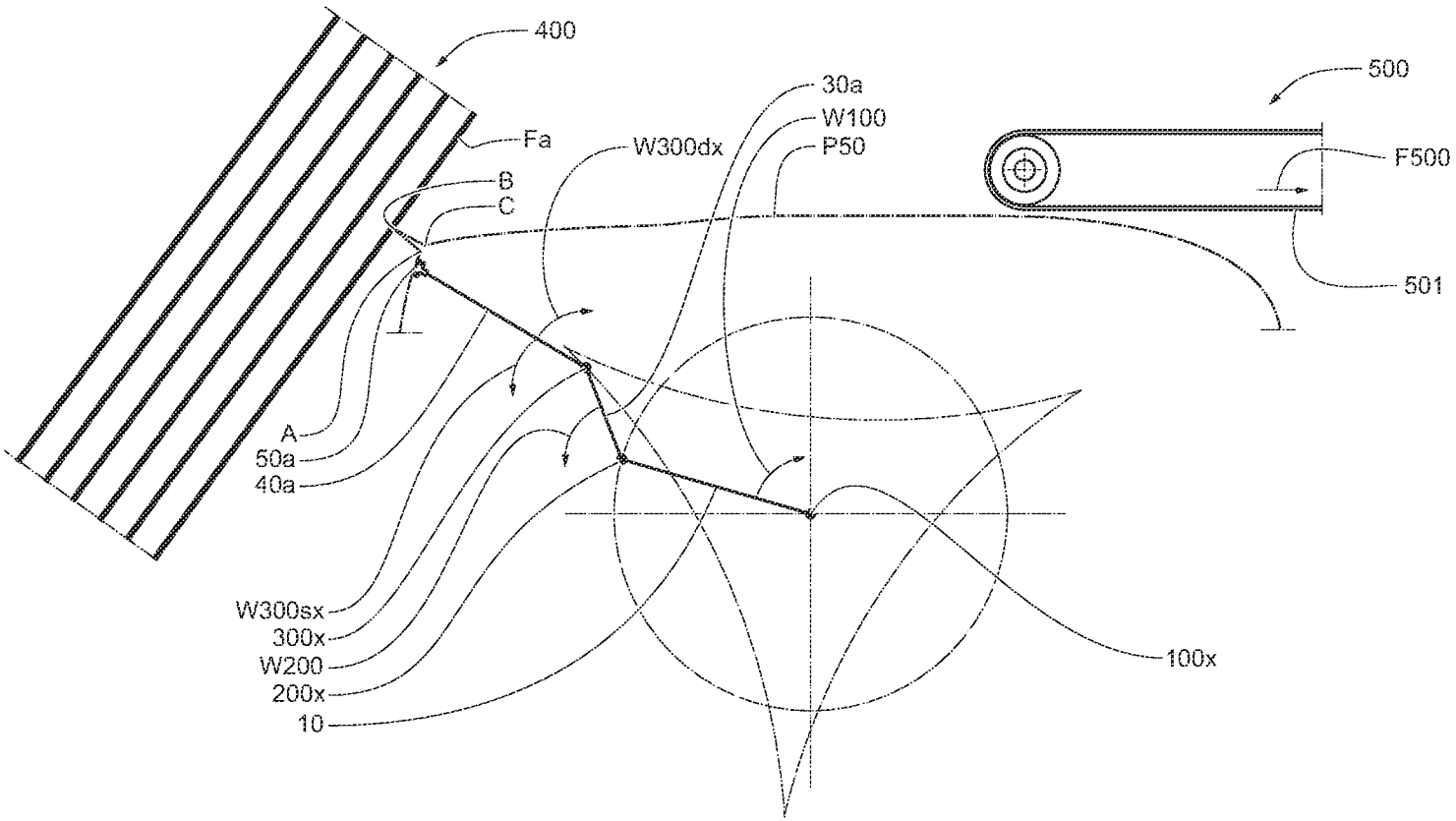
Figure 4B:
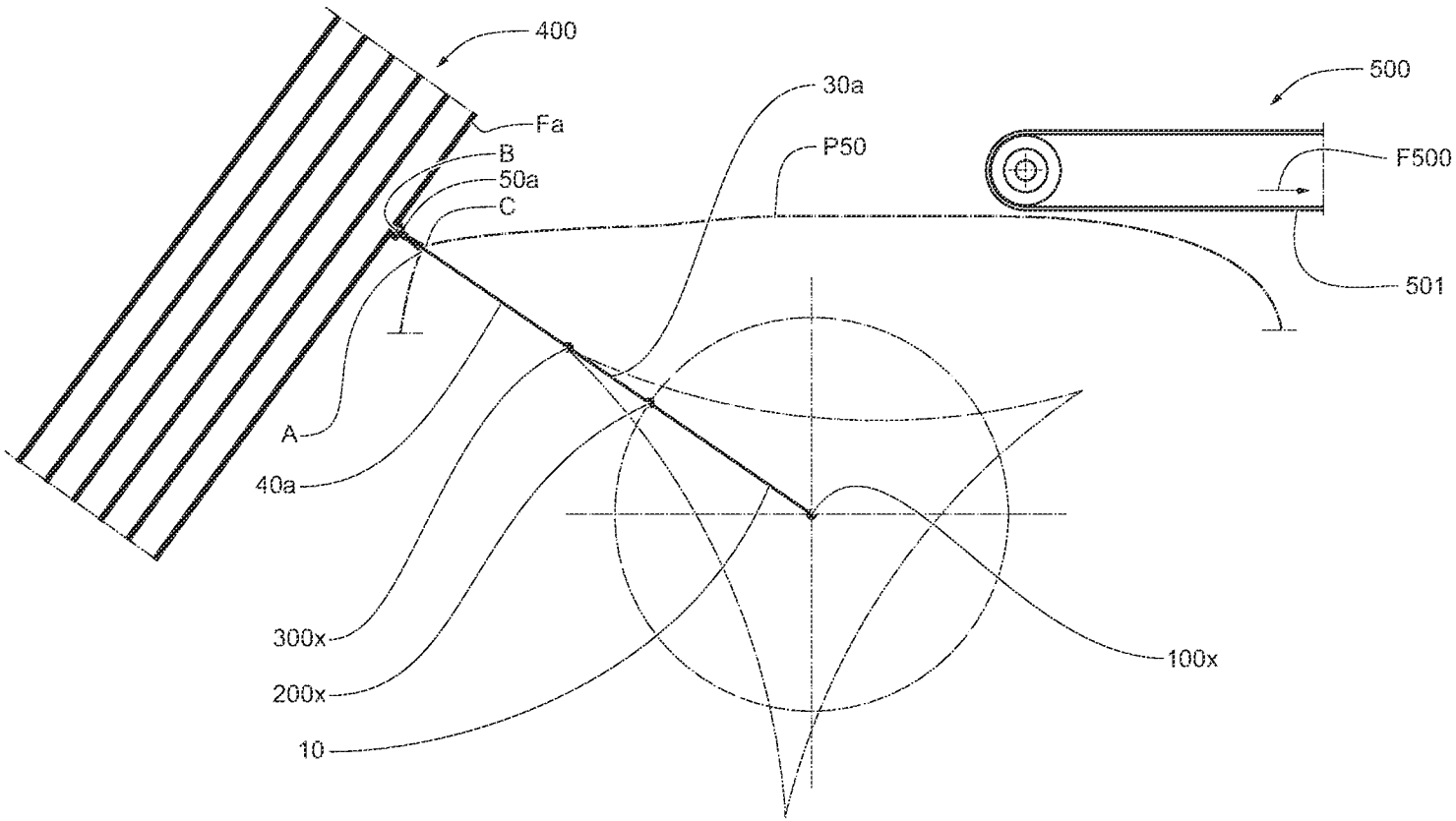
Figure 4C:
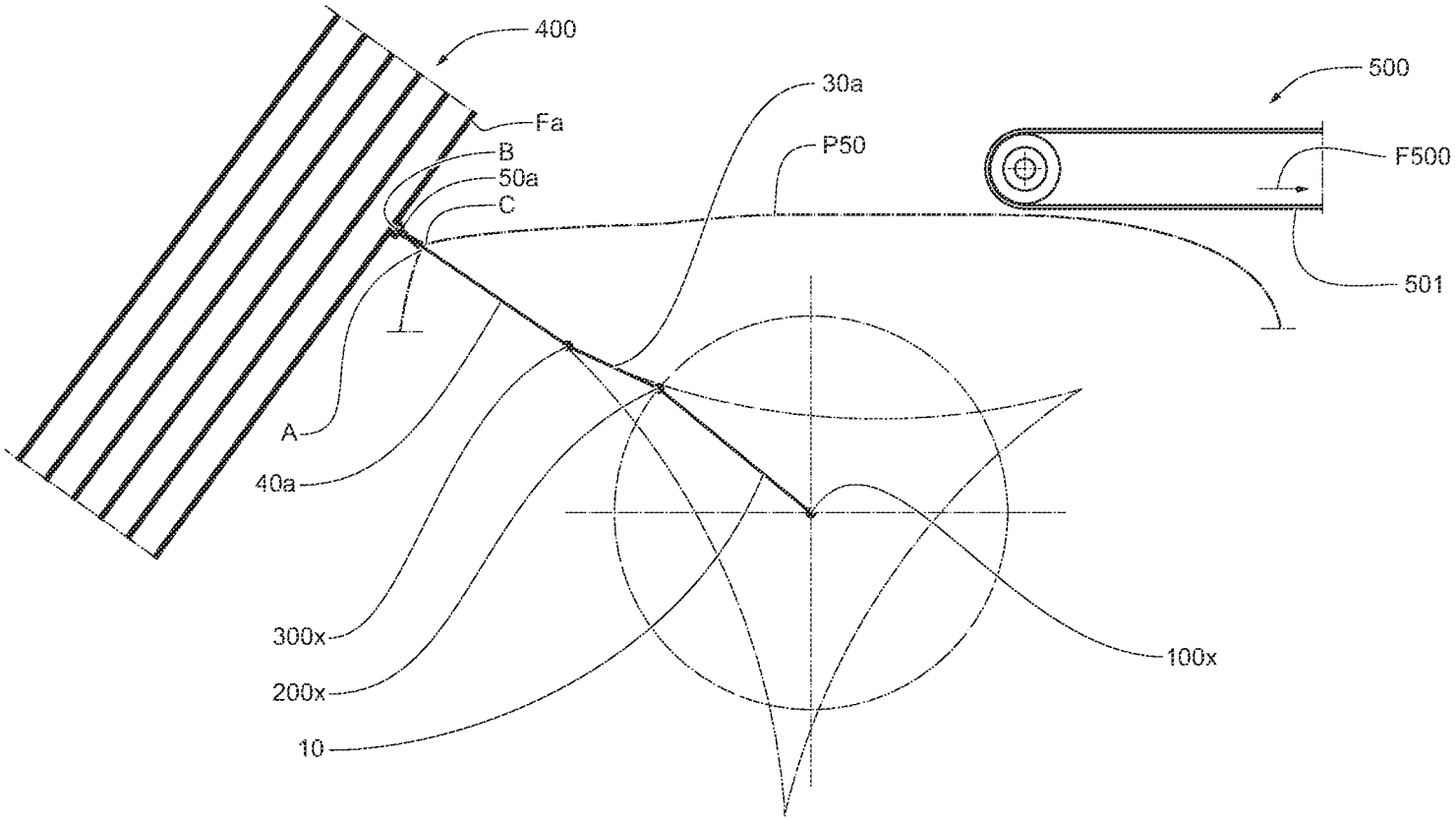
Figure 4D:
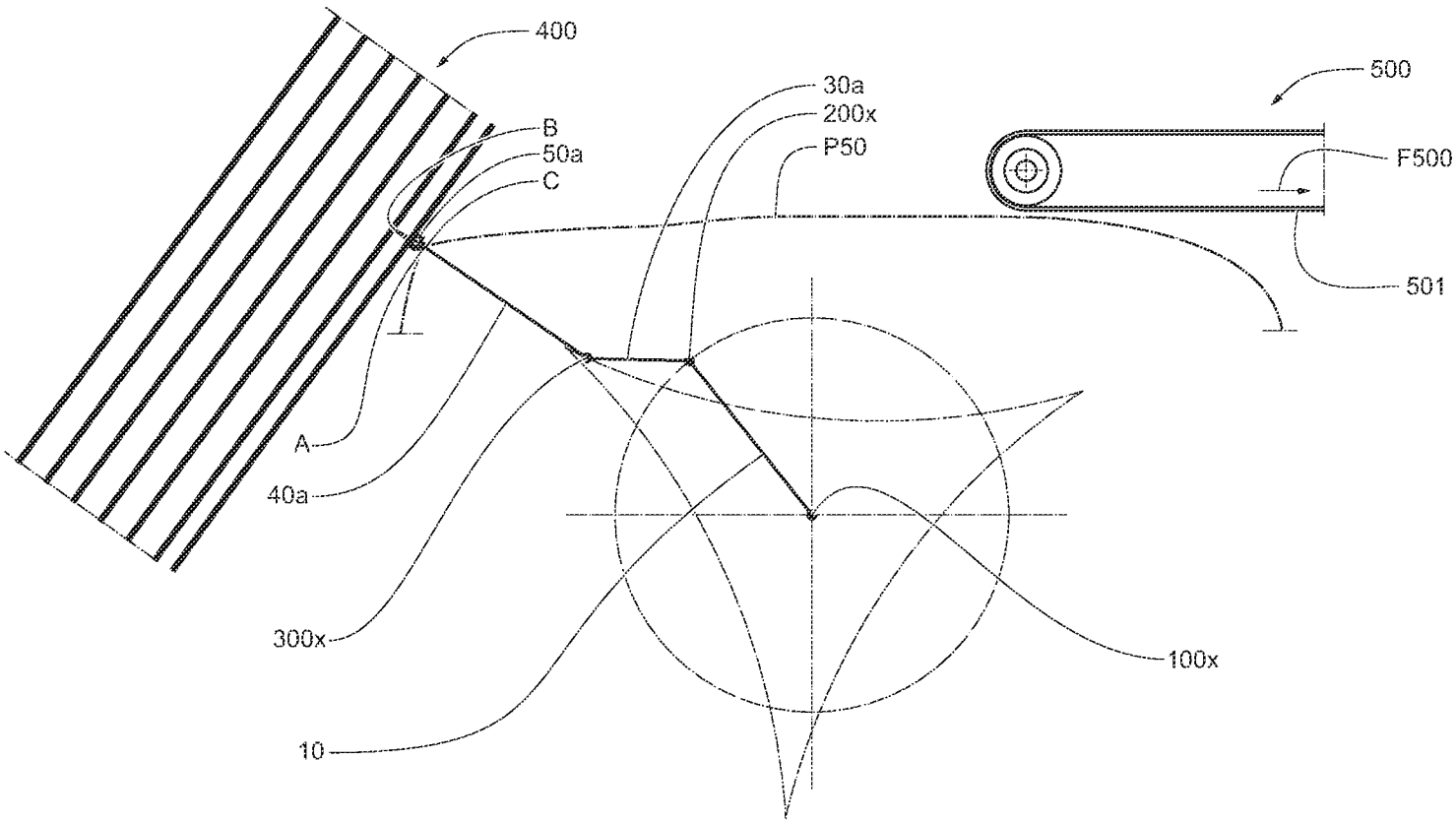
Figure 4E:
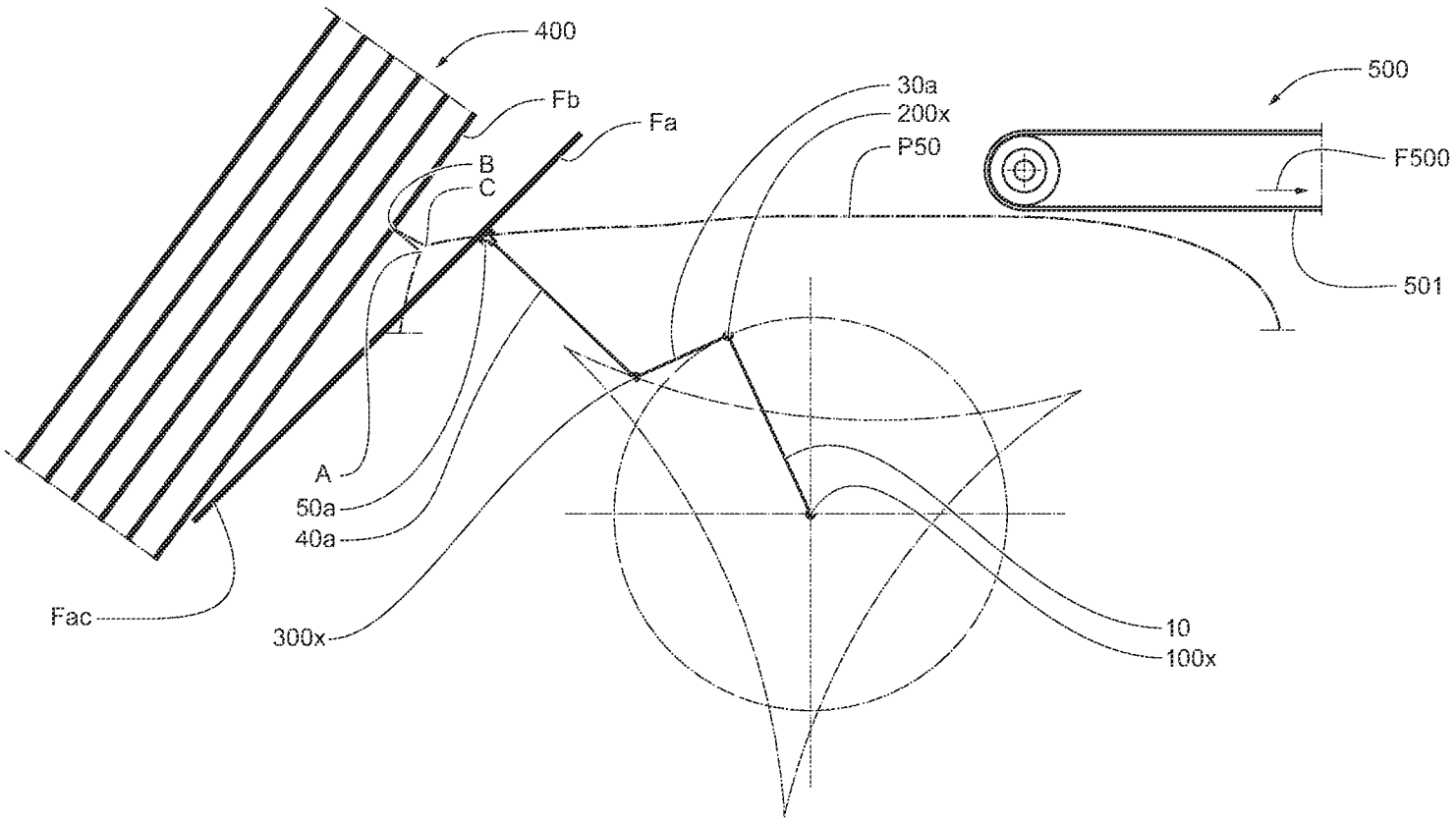
Figure 4F:
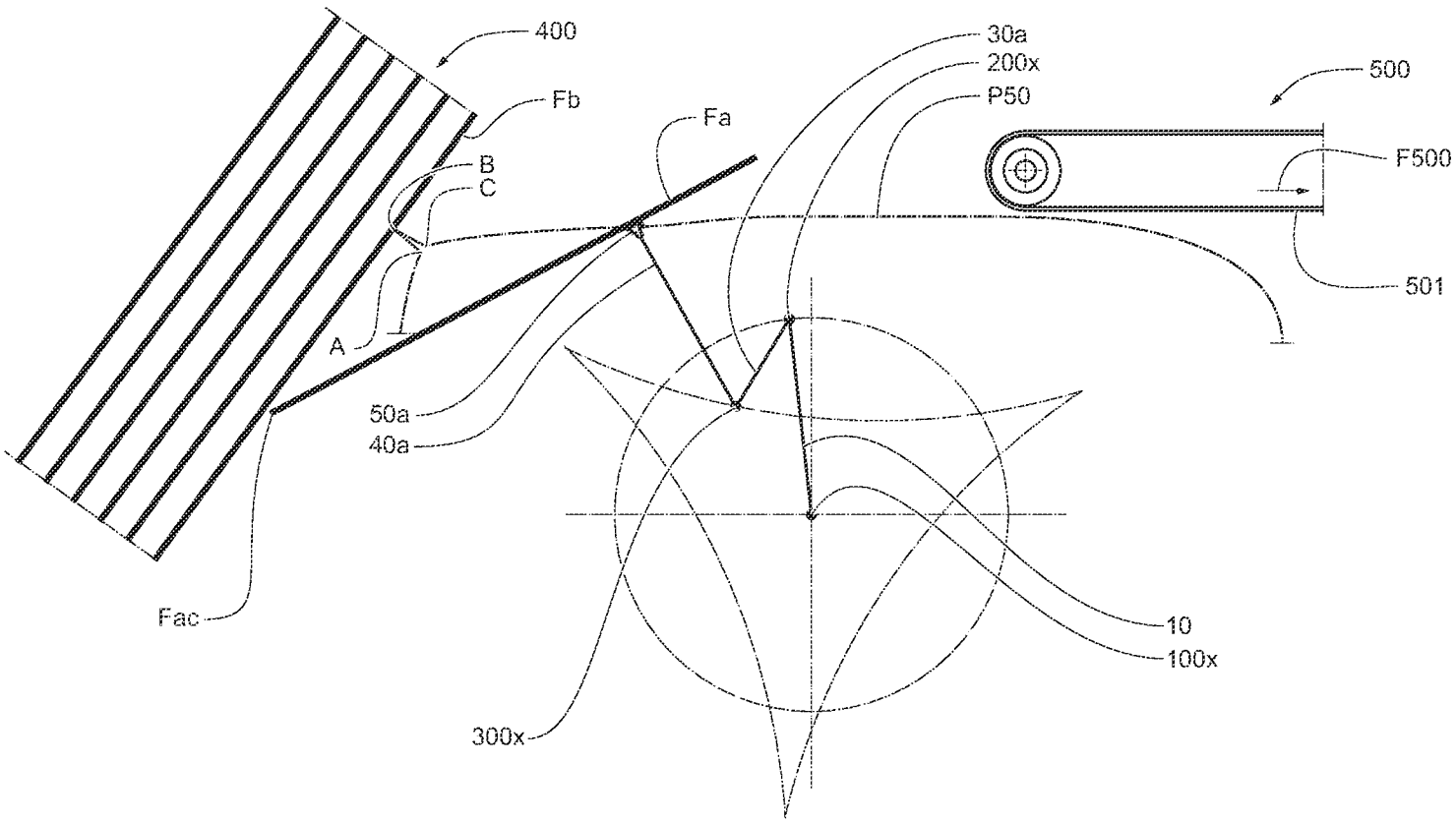
Figure 4G:
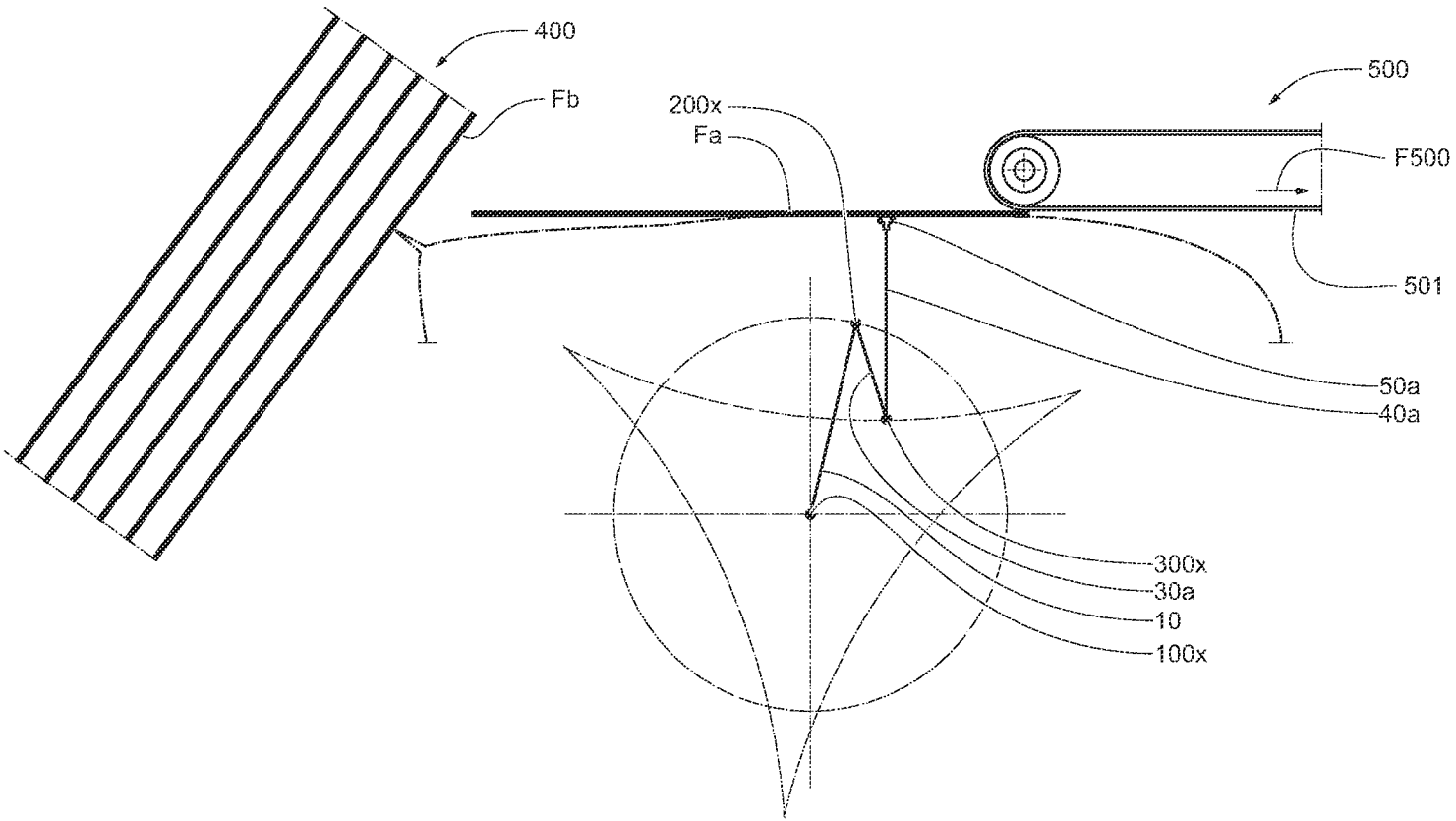
Figure 4H:
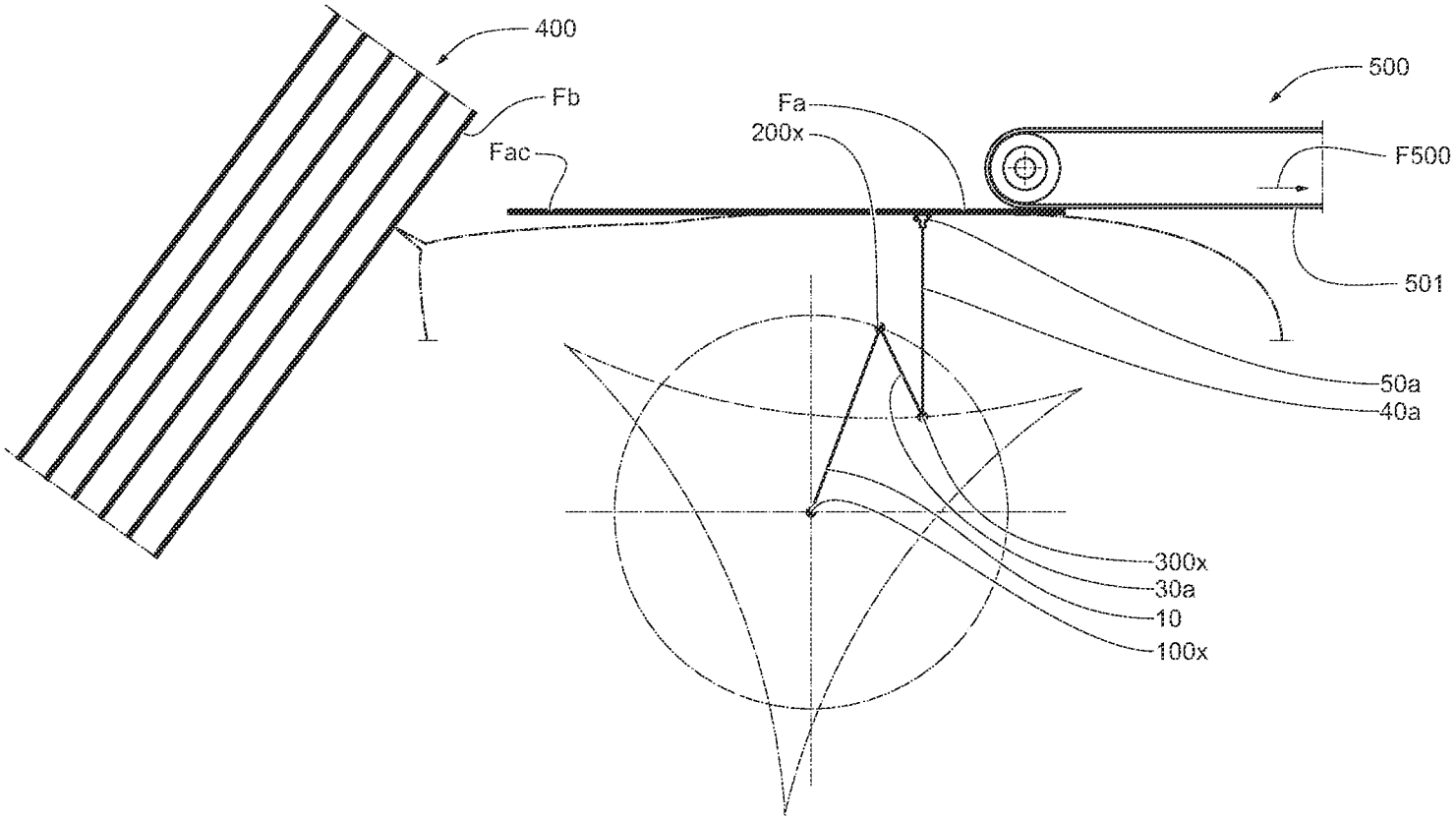

With reference to the above description and to FIG. 4A, it is evident that by the operating of the first actuator means M1 the shaft 100 and the associated rotating elements 10 and 20 are conducted in rotation, for example in clockwise rotation, W100, with consequent anti-clockwise epicyclical rotation, W200, of the two planetary shafts 210*a* and 210*b* and of the relative arms 30*a* and 30*b*, in which the angular speed of the anti-clockwise epicycloidal rotation W200 is determined by the transmission relationship between the wheels of the first transmission means 60*a*-60*b*, while, with reference to the oscillation-rotation of the planet shaft 300 and, therefore, with reference to the rotation-oscillation of the second arms 40*a*-40*e*-40*c*, the rotation-oscillation of the shaft 300 can be freely selected with reference to the two directions, W300*sx* or W300*dx*, as well as also freely selected/adopted with reference to the angular speed, in which the direction and the angular speed can be freely changed and/or freely varied during the rotation of the two rotating elements 10 and 20.

EXEMPLIFICATIVE OPERATION

With reference to the FIGS. from 4A to 4H they show an exemplificative and non limitative modus operandi of the system object of the present invention in which, in the illustrated case, the rotating system, by a specific software recorded into the control unit 90 is able to control the two servomotors M1 and M2, executing some operations as to withdraw from a store 400 a blank, to transport the blank withdrawn toward a conveyor, and to feed the same blank above-against the conveyor 500 having a suction belt type, in which the operations are executed by moving the gripper means 50*a*-50*e*-50*b* along a determined path P50 better described hereinafter, in which the operations are executed adopting same particular orientations for the grasping plane of the gripping means (i.e. for the grasping plane of the suction cups) 50*a*-50*e*-50*b* during the movement along the path 50.

With reference to the above structural description, through the driving of the motor M1, the shaft 100 and the associated rotating elements 10 and 20 are driven in a clockwise rotation, W100, preferably with continuous motion, with consequent driven in anti-clockwise epicycloidal rotation W200 of the two planetary shafts 210*a* and 210*b* and of the relative arms 30*a* and 30*b*.

With reference to the FIGS. from 4A and 4B, during the operations of contact and of grasping of the blank Fa, through driving of the motor M2, the angular rotation W300 of the shaft 300 is varied in a manner able to obtain with reference to the gripper means 50*a*-50*e*-50*b* a substantially radial movement, see segment AB of the path P50 and, furthermore, during the phase of contact of the blank Fa, see point C of the path 50, the gripper means 50*a*-50*e*-50*f* have tangential speed equal to zero, with consequent absence of relative movement (i.e. absence of sliding) between the blank Fa and the gripper means 50*a*-50*e*-50*b*.

With reference to the FIGS. from 4C and 4D, during the operations of extraction of the blank Fa from the store 400, through driving of the servomotor M2, the angular speed rotation W300 of the shaft 300 is varied in a manner to obtain with reference to the gripper means 50*a*-50*e*-50*b* a substantially radial movement, see segment BC of the path P50.

With reference to the FIGS. from 4E to 4F, during the operations of transport of the blank Fa toward the conveyer 500, through driving of the motor M2, the angular rotation W300 of the shaft 300 is varied in a manner able to obtain with reference to the gripper means 50*a*-50*e*-50*b* a movement/inclination able to avoid interference between the tail Fac of the blank Fa and the successive blank Fb which is positioned into the store 400.

With reference to the FIGS. from 4G to 4H, during the operations of feeding the blank Fa against the belt 501 of the conveyer 500, through driving of the motor M2, the angular rotation W300 of the shaft 300 is varied in manner to obtain with reference to the gripper means 50*a*-50*e*-50*b*, a parallel disposition between the blank Fa and the grasping plain configured by the grasping belt 501, and, in this manner, move the blank Fa toward and against the suction belt 501 and, at the same time, preferably, with reference to the blank Fa, execute a linear advancement with a linear speed equal to the linear speed of the suction belt 501.

With reference to the FIGS. from 4F to 4G, during the operations of transport and feeding of the blank Fa the one or more second arms 40*a*, 40*e*, 40*b* are moved in such way able to pass through the aperture 230.

The descriptions of the aforementioned system and modus operandi are given purely as an example and are not to be considered a restriction and, therefore, it is obvious that suggested modifications and/or variations could be made to them during their practice and/or by their use, anyways within the scope of the following claims.

In such context, these following claims also form an integral part of the description stated above.

The invention claimed is:

1. A rotating system to withdraw, to transport and to supply blanks, the system comprising:

two rotating elements disposed opposite one another and spaced among them;

a first sun shaft act to support and rotate the two rotating elements;

a first planetary shaft and a second planetary shaft disposed coaxial among them, in which the first and the second planetary shafts are disposed parallel and radially spaced with respect to the first sun shaft, in which the first and the second planetary shafts are supported in a rotating manner by the first and the second rotating element, in which the first and the second planetary shafts are designed to move along a circular orbit around the first sun shaft;

two first arms, in which the two first arms extend with radial orientation with respect to the first and respectively to the second planetary shafts, in which the two first arms have two respective proximal portions respectively fixed on the first and second planetary shafts;

a third planet shaft, in which the third planet shaft is supported in rotating manner by respective distal portions of the respective two first arms;

one or more second arms, in which the one or more second arms extend with radial orientation with respect to the third planet shaft, in which the one or more second arms have proximal portion fixed on the third planet shaft;

one or more gripper means, in which the one or more gripper means are supported in proximity of the distal portions of the one or more second radial arms;

first transmission means, in which the first transmission means are able to rotate the first and the second planetary shafts in the same direction with respect to their axis, in relationship of phase with respect to the rotation and to the angular positions of the two rotating elements;

second transmission means, in which the second transmission means are able to rotate-oscillate the third planet shaft in independent manner with respect to the rotation and with respect to the angular positions of the two rotating elements and in an independent manner with respect to the rotation and with respect to the angular positions of the two planetary shafts;

first actuator means able to rotate the first sun shaft;

second actuator means able to rotate-oscillate the third planet shaft by the second transmission means;

synchronizer means able to synchronize the first and the second actuator means.

2. The system defined in claim 1, wherein the first planetary shaft and the second planetary shaft are axially spaced with the purpose to form an aperture and by the fact that the one or more second arms are designed to move through the aperture.

3. The system defined in claim 1, wherein the first transmission means comprise a first transmission unit and a second transmission unit, and the first transmission unit is able to rotate the first planetary shaft and the second transmission unit is able to rotate the second planetary shaft.

4. The system defined in claim 1, wherein the first or the second transmission unit comprises:

a first sun wheel;

a second wheel supported in a rotating manner through the rotating element, in which the second wheel is in mesh with the first sun wheel;

a third wheel supported and fixed to the first or second planetary shaft, in which the third wheel is in mesh with the second wheel.

5. The system defined in claim 1, wherein the second transmission means are able to connect the third planetary shaft with the second actuator means in an independent manner with respect the other operational elements.

6. The system defined in claim 1, wherein the second transmission means comprise:

a first pulley, in which the axis of rotation of the first pulley is coaxial with respect to the first axis;

a second pulley, in which the second pulley is fixed on a first sleeve of support, in which the first sleeve of support is supported in a rotating manner by one of the two rotating elements;

a first belt of transmission wound on the first pulley and on the second pulley;

a third pulley, in which the third pulley is fixed on the first sleeve of support;

a fourth pulley, in which the fourth pulley is fixed on a second sleeve of support, in which the second sleeve of support is supported in rotating manner in proximity of the distal end of the first radial arm;

a second belt of transmission wound on the third pulley and on the fourth pulley; and the first pulley is operated in oscillation-rotation through the second actuator means.

7. The system defined in the claim 6, wherein the first sleeve supports internally the second planetary shaft in a rotating manner.

8. The system defined in the claim 6, wherein the second sleeve supports internally the third planet shaft in a rotating manner.

9. The system defined in claim 6, wherein the first pulley comprises a cup element supported by the frame in which the cup element supports to its inside in a rotating manner the free end of the first shaft.

10. The system defined in claim 1, wherein the first actuator means comprise a first servo-motor, the second actuator means comprise a second servo-motor, and the synchronizers mean comprises a programmable control unit able to control the rotation of the two servo-motors.

11. The system defined in claim 1, wherein the first actuator means comprise a mechanical connection with the cycle of an operative machine, the second actuator means comprise a second servo-motor, and the synchronizer means comprises a programmable control unit which is able to control the second servomotor on the base of the angular positions assumed by the rotating element and on the base of the angular positions assumed by the two planetary shafts.

12. The system defined in claim 1, wherein the second arms have their proximal portion fixed to the third planet shaft in way offset with respect to the axis of oscillation-rotation of the same planet shaft.

13. The system defined in claim 1, further comprising:

two gripper units disposed opposite among them;

two rotating elements which are disposed opposite one another and spaced among them;

a first sun shaft act to support and to rotate the two rotating elements;

a first couple of planetary shafts associated to the first gripper unit;

a second couple of planetary shafts associated to the second gripper unit;

a first couple of two first arms associated to the first gripper unit;

a second couple of two first arms associated to the second gripper unit;

a first third planet shaft associated to the first gripper unit;

a second third planet shaft associated to the second gripper unit;

a first plurality of one or more second arms associated to the first gripper unit;

a second plurality of one or more second arms associated to the second gripper unit;

a first plurality of one or more gripper means associated to the first gripper unit;

a second plurality of one or more gripper means associated to the second gripper unit;

a first unit of first transmission means associated to the first gripper unit;

a second unit of first transmission means associated to the second gripper unit;

a first unit of second transmission means associated to the first gripper unit;

a second unit of second transmission means associated to the second gripper unit.

14. The system defined in claim 1, wherein the first sun shaft performs a first angular rotation in a first direction, the second planetary shafts perform a second angular rotation in a second direction opposite with respect to the first rotation and a angular rotation synchronized with respect to the rotation and to the angular position of the first sun shaft, and the third planet shaft rotates-oscillates in independent manner with respect to the rotation and to the angular position of the first sun shaft and in an independent manner with respect to the rotation and to the angular position to the second shaft.

15. The system defined in claim 1, wherein during the rotation of the two rotating elements the second actuator means provide to oscillate the third axis-shaft with the purpose to obtain with reference to the gripper means a substantially radial movement.

16. The system defined in claim 1, wherein during the rotation of the two rotating elements the second actuator means provide to oscillate the third shaft with the purpose to obtain with reference to the gripper means a movement able to obviated the interference between the tail of the withdrawn blank and subsequent blank lodged into the store of collecting.

17. The system defined in claim 1, wherein during the rotation of the two rotating elements the second actuator means provide to oscillate the third shaft with the purpose to obtain with reference to the gripper means a rectilinear movement.

* * * * *